US009564700B2

(12) United States Patent
Matsumura et al.

(10) Patent No.: US 9,564,700 B2
(45) Date of Patent: Feb. 7, 2017

(54) DOWNSIZED TERMINAL HAVING A BOX-SHAPED BODY PART

(71) Applicant: YAZAKI CORPORATION, Minato-ku, Tokyo (JP)

(72) Inventors: Kaoru Matsumura, Shizuoka (JP); Tomoyoshi Fukaya, Shizuoka (JP); Kenji Kajikawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/800,759

(22) Filed: Jul. 16, 2015

(65) Prior Publication Data

US 2015/0318632 A1 Nov. 5, 2015

Related U.S. Application Data

(63) Continuation of application No. PCT/JP2014/050532, filed on Jan. 15, 2014.

(30) Foreign Application Priority Data

Jan. 18, 2013 (JP) ..... 2013-006981

(51) Int. Cl.
*H01R 13/187* (2006.01)
*H01R 13/42* (2006.01)
(Continued)

(52) U.S. Cl.
CPC ..... *H01R 13/42* (2013.01); *H01R 13/04* (2013.01); *H01R 13/4223* (2013.01); *H01R 4/185* (2013.01); *H01R 43/16* (2013.01)

(58) Field of Classification Search
CPC .... H01R 13/187; H01R 13/113; H01R 13/115
(Continued)

(56) References Cited

U.S. PATENT DOCUMENTS 5,533,914 A * 7/1996 Sawada ..... H01R 13/187 439/843
6,089,928 A 7/2000 Miwa et al.
(Continued)

FOREIGN PATENT DOCUMENTS

JP H02-102679 U 8/1990
JP H11-283688 A 10/1999
(Continued)

OTHER PUBLICATIONS

Official Action issued on Jul. 5, 2016 in the counterpart Chinese application.
(Continued)

*Primary Examiner* — Abdullah Riyami
*Assistant Examiner* — Thang Nguyen
(74) *Attorney, Agent, or Firm* — Mots Law, PLLC

(57) ABSTRACT

A terminal includes a box-shaped body part including a pair of a first side wall and second side wall which are raised from both side ends of a bottom wall, a top wall extended from the first side wall, and an auxiliary wall extended from the second side wall. The top wall includes a first slit opening on a side end face of the top wall. The auxiliary wall includes a second slit opening on a side end face of the auxiliary wall. A stabilizer is formed by a portion on a front side of a separating portion formed by the second slit. A stabilizer reinforcing section is formed by a portion on a front side of a separating portion formed by the first slit. An engagement section is formed by a portion on a rear side of the separating portion formed by the first slit of the top wall.

13 Claims, 7 Drawing Sheets

(51) Int. Cl.

| | |
|---|---|
| ***H01R 13/04*** | (2006.01) |
| ***H01R 13/422*** | (2006.01) |
| *H01R 4/18* | (2006.01) |
| *H01R 43/16* | (2006.01) |

(58) Field of Classification Search
USPC ..... 439/845, 849, 842
See application file for complete search history.

(56) References Cited

U.S. PATENT DOCUMENTS

| | | | | |
|---|---|---|---|---|
| 7,458,863 | B2 * | 12/2008 | Shimizu | H01R 43/16 439/839 |
| 9,281,575 | B2 * | 3/2016 | Matsumura | H01R 13/422 |
| 2004/0253881 | A1 * | 12/2004 | Sakurai | H01R 4/185 439/752 |
| 2008/0146090 | A1 * | 6/2008 | Shimizu | H01R 43/16 439/842 |

FOREIGN PATENT DOCUMENTS

| | | | |
|---|---|---|---|
| JP | 2005-005109 | A | 1/2005 |
| JP | 2008-153074 | A | 7/2008 |

OTHER PUBLICATIONS

Official Action issued on Jun. 7, 2016 in the counterpart Japanese application.
Official Action issued on Oct. 25, 2016 in the counterpart United Kingdom application.

* cited by examiner

DOWNSIZED TERMINAL HAVING A BOX-SHAPED BODY PART

CROSS REFERENCE TO RELATED APPLICATIONS

This application is a continuation of International Application No. PCT/JP2014/050532, filed Jan. 15, 2014, and based upon and claims the benefit of priority from Japanese Patent Application No. 2013-006981, filed Jan. 18, 2013, the entire contents of all of which are incorporated herein by reference.

TECHNICAL FIELD

The present invention relates to a terminal housed in a connector housing.

BACKGROUND

As a conventional terminal of this kind, there is one disclosed in JP 2008-153074 A (PTL 1). A male terminal 50 as a conventional terminal, as illustrated in FIGS. 7 and 8, is formed by folding a conductive metal plate of a predetermined shape. The male terminal 50 includes a box-shaped body part 51, a terminal contact part 70 disposed on a front side of the body part 51, and an electric wire connecting part 71 disposed on a rear side of the body part 51.

The body part 51 includes a bottom wall 52, a pair of a first side wall 53 and a second side wall 54 which are raised from both side ends of the bottom wall 52, a top wall 55 which is extended from the first side wall 53, and an auxiliary wall 56 which is extended from the second side wall 54.

On the top wall 55, a hole 59 for forming a stabilizer 57 and an engagement section 58 is formed. The stabilizer 57 is integrally provided from a part of the top wall 55. The engagement section 58 is formed by a portion of the top wall 55 on the front side of the hole 59, and the front end face of the hole 59 is made as an engagement face 58*a*. Inside the hole 59 is made as an entry space for an elastic lance (not illustrated).

On the auxiliary wall 56, a cutout portion 61 (see FIG. 8) is formed. The cutout portion 61 is formed in a shape that approximately coincides with the opening of the hole 59. That is, it is dimensioned such that it does not close the opening of the hole 59.

When the male terminal 50 is inserted into a terminal housing chamber of a connector housing (not illustrated), the stabilizer 57 serves as a guide by being inserted in a guide groove inside the connector housing, and prevents an insertion in a direction other than a proper terminal direction (such as a direction that is turned upside down). The elastic lance is engaged with the engagement section 58 in a state that the male terminal 50 is housed in the terminal housing chamber. Thus, the male terminal 50 is fixed so as not to come off from the terminal housing chamber.

SUMMARY

However, in the conventional male terminal 50, the hole 59 for forming the stabilizer 57 and the engagement section 58 is provided on the top wall 55. It is necessary that the hole 59 has a dimension that is equal to or greater than the length dimension of the stabilizer 57 or the entry space for the elastic lance, whichever dimension is greater, and it is usually a long dimensioned hole. Therefore, the dimension L2 of the body part 51 becomes long and there is a problem that the body part 51 cannot be downsized.

Also, when the length of the body part 51 is large, the distance from the terminal contact part 70 to a conductive portion with the electric wire of the electric wire connecting part 71 becomes large. This makes an electric resistance of the male terminal 50 high, and it becomes a cause of deteriorating the electrical performance of the male terminal 50.

Accordingly, the present invention was made in order to solve the above-mentioned problems and its object is to provide a terminal that can downsize a box-shaped body part.

A terminal according to an aspect of the present invention is a terminal housed in a connector housing, which includes a box-shaped body part and an electric wire connecting part disposed on a rear side of the body part. The body part includes a bottom wall, a first side wall raised from one side end of the bottom wall, a second side wall raised from the other side end of the bottom wall, a top wall which is extended from the first side wall, and an auxiliary wall which is extended from the second side wall. A first slit which opens on a side end face of the top wall is provided at the top wall. A second slit which opens on a side end face of the auxiliary wall is provided at the auxiliary wall. A stabilizer is formed by a portion on a front side of a separating portion formed by the second slit of the auxiliary wall. A stabilizer reinforcing section is formed by a portion on a front side of a separating portion formed by the first slit of the top wall. An engagement section is formed by a portion on a rear side of the separating portion formed by the first slit of the top wall.

By forming the first slit on the top wall and forming the second slit on the auxiliary wall, the stabilizer, the stabilizer reinforcing section, and the engagement section are provided by utilizing the separating portions formed by the first slit and the second slit without forming a hole such as in a conventional terminal, and thus, it is possible to shorten the dimension in the longitudinal direction of the body part and to downsize.

The terminal according to an embodiment of the present invention may further include a terminal contact part which is disposed on a front side of the body part. Even when it is further provided with the terminal contact part which is disposed on the front side of the body part, since an electric resistance can be made small by downsizing the box-shaped body part, it is possible to improve the electric performance of the terminal.

A tab-entry-prevention part may also be formed by a portion on a rear side of the separating portion formed by the second slit of the auxiliary wall. With such a structure, even when the tab-entry-prevention part is provided, it is possible to shorten the dimension in the longitudinal direction of the body part and to downsize.

DESCRIPTION OF EMBODIMENTS

Hereinafter, a terminal according to an embodiment of the present invention will be explained by referring to FIGS. 1 to 6.

Figure 1A:
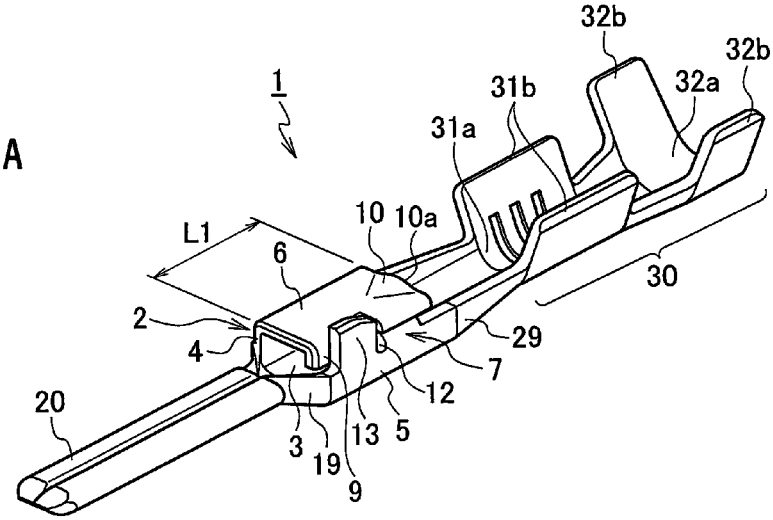
FIG. 1A is a perspective view of a male terminal as a terminal according to an embodiment.
Figure 1B:
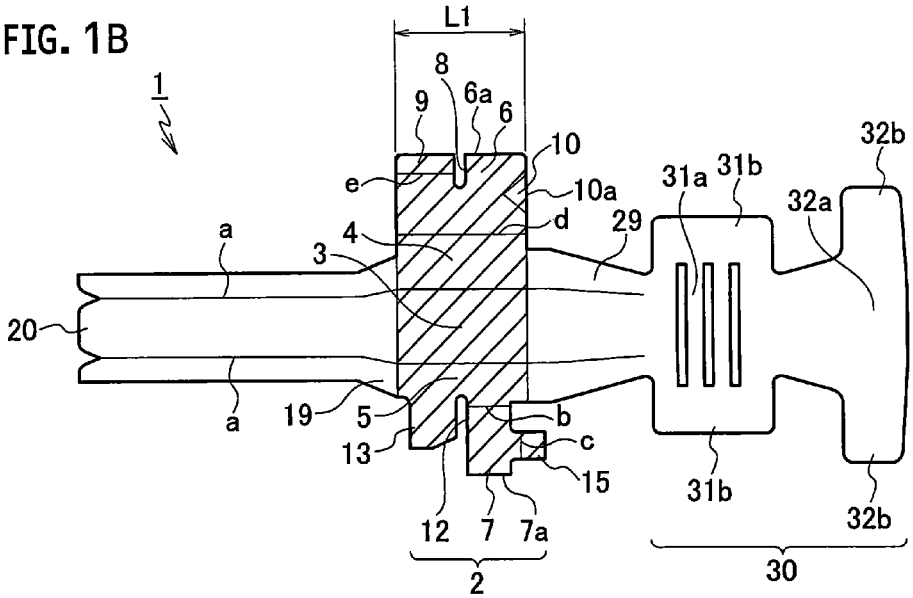
FIG. 1B is a development view of the male terminal.
Figure 2:
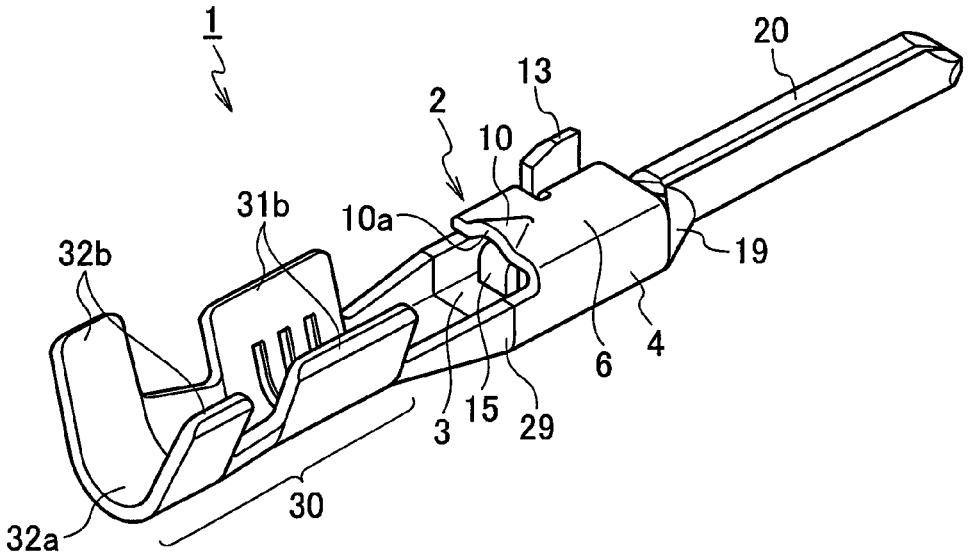
FIG. 2 is a perspective view of the male terminal seen from a direction different from FIG. 1A.
Figure 3A:
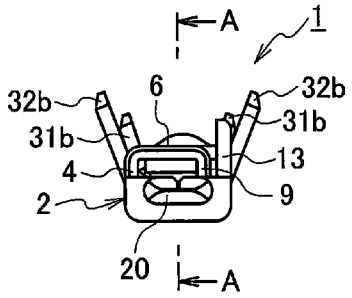
FIG. 3A is a front view of the male terminal.
Figure 3B:
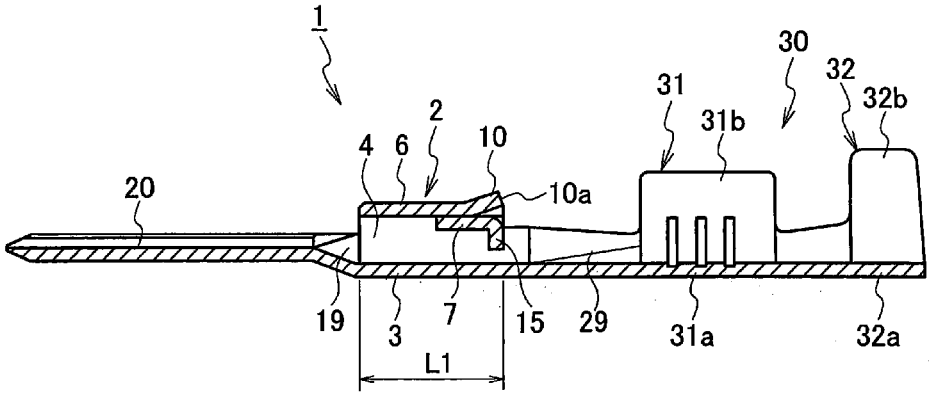
FIG. 3B is a sectional view taken along line A-A of FIG. 3A.
Figure 4A:
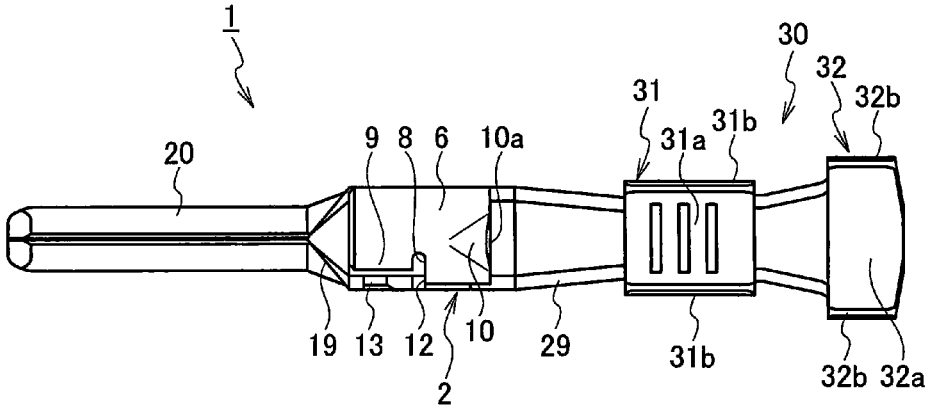
FIG. 4A is a plan view of the male terminal.
Figure 4B:
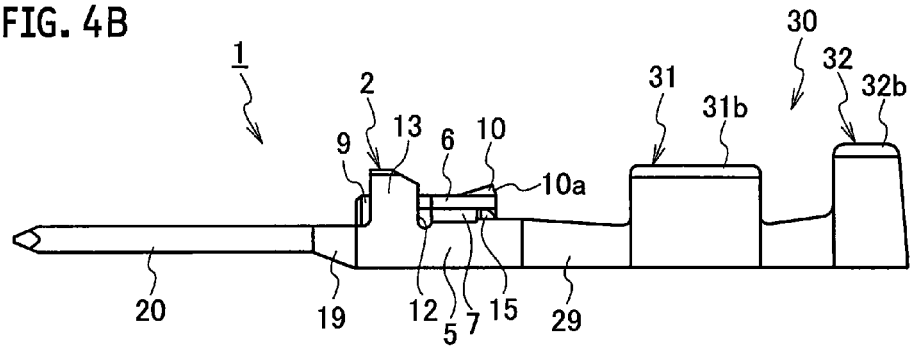
FIG. 4B is a side view of the male terminal.
Figure 4C:
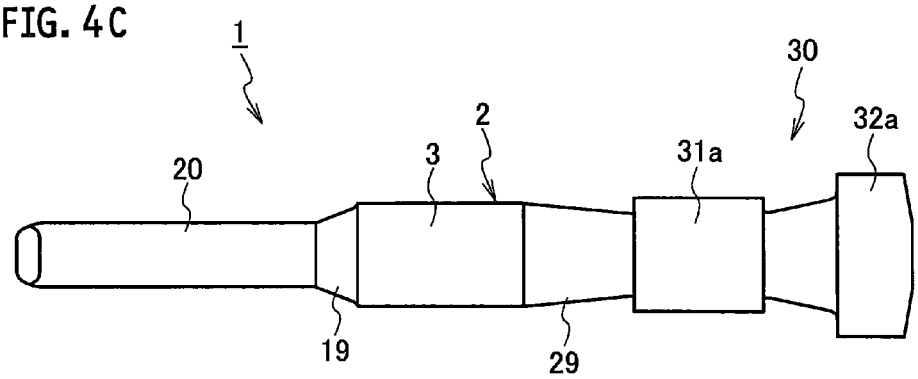
FIG. 4C is a bottom view of the male terminal.

As illustrated in FIGS. 1 to 4, a male terminal 1 as a terminal according to the embodiment is formed by folding a conductive metal plate of a predetermined shape as illustrated in FIG. 1B. The male terminal 1 includes a box-shaped body part 2, a terminal contact part 20 which is disposed on the front side of the body part 2 via a first tapered coupling part 19, and an electric wire connecting part 30 which is disposed on the rear side of the body part 2 via a second tapered coupling part 29.

The terminal contact part 20 has a tab shape. The terminal contact part 20 is formed by folding along line "a" of FIG. 1B such that the two faces lie on top of each other.

The electric wire connecting part 30 includes a conductor connecting part 31 and an insulator connecting part 32. The conductor connecting part 31 includes a first bottom wall 31*a* and a pair of first tongue pieces 31*b* which are protruded from both side ends of the first bottom wall 31*a*. The insulator connecting part 32 includes a second bottom wall 32*a* and a pair of second tongue pieces 32*b* which are protruded from both side ends of the second bottom wall 32*a*. The first bottom wall 31*a* and the second bottom wall 32*a* are bent into gradual arc-shapes toward the insides. An electric wire (not illustrated) in a state that its coating is removed at its end, that is, only the conductive part is crimped and fixed to the conductor connecting part 31. The end of the electric wire (not illustrated) that includes the coating, that is, the insulator is crimped and fixed to the insulator connecting part 32.

The body part 2 includes a bottom wall 3, a first side wall 4 raised from one side end of the bottom wall 3, a second side wall 5 raised from the other side end of the bottom wall 3, a top wall 6 which is extended from the first side wall 4, and an auxiliary wall 7 which is extended from the second side wall 5.

The top wall 6 is bent in a horizontal direction with respect to the first side wall 4 along line "d" of FIG. 1B. A first slit 8 which opens on a side end face 6*a* of the top wall 6 is provided at the top wall 6. At the top wall 6, a stabilizer reinforcing section 9 is formed by a separated portion on the front side of the first slit 8. The stabilizer reinforcing section 9 is formed by being bent vertically downward along line "e" of FIG. 1B with respect to the top wall 6. The stabilizer reinforcing section 9 comes close to or comes in contact with a stabilizer 13. Thus, the stabilizer reinforcing section 9 blocks inward deviation or inclination of the stabilizer 13. At the top wall 6, an engagement section 10 is provided at a portion on the rear side of the first slit 8. The engagement section 10 is raised slightly compared to other portions of the top wall 6 by being folded in a triangular shape. A rear end face of the engagement section 10 is made as an engagement face 10*a*. A rear space of the top wall 6, that is, a rear space of the body part 2 is utilized as an entry space for an elastic lance 43.

The auxiliary wall 7 is bent in a horizontal direction with respect to the second side wall 5 along line "b" of FIG. 1B except for the stabilizer 13. The auxiliary wall 7 is arranged on a lower face of the top wall 6 so as to overlap with each other. A second slit 12 which opens on a side end face 7*a* of the auxiliary wall 7 is provided at one place at the auxiliary wall 7. At the auxiliary wall 7, a stabilizer 13 is formed by a separated portion on the front side of the second slit 12. The stabilizer 13 is arranged straight with respect to the second side wall 5 and protrudes in a vertical direction. At the auxiliary wall 7, a tab-entry-prevention part 15 is provided at a portion on the rear side of the second slit 12. The tab-entry-prevention part 15 is bent vertically downward along line "c" of FIG. 1B with respect to the auxiliary wall 7. The tab-entry-prevention part 15 is arranged so as to close a rear opening of the body part 2.

Figure 5:
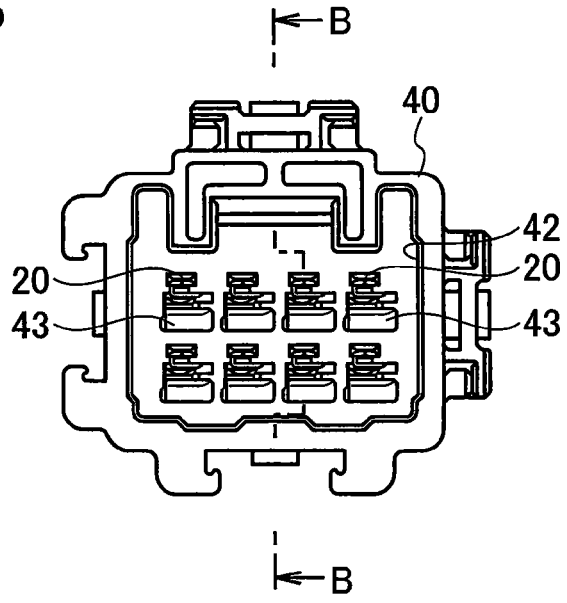
FIG. 5 is a view of a state seen from a front in which the male terminals are housed inside a connector housing.
Figure 6:
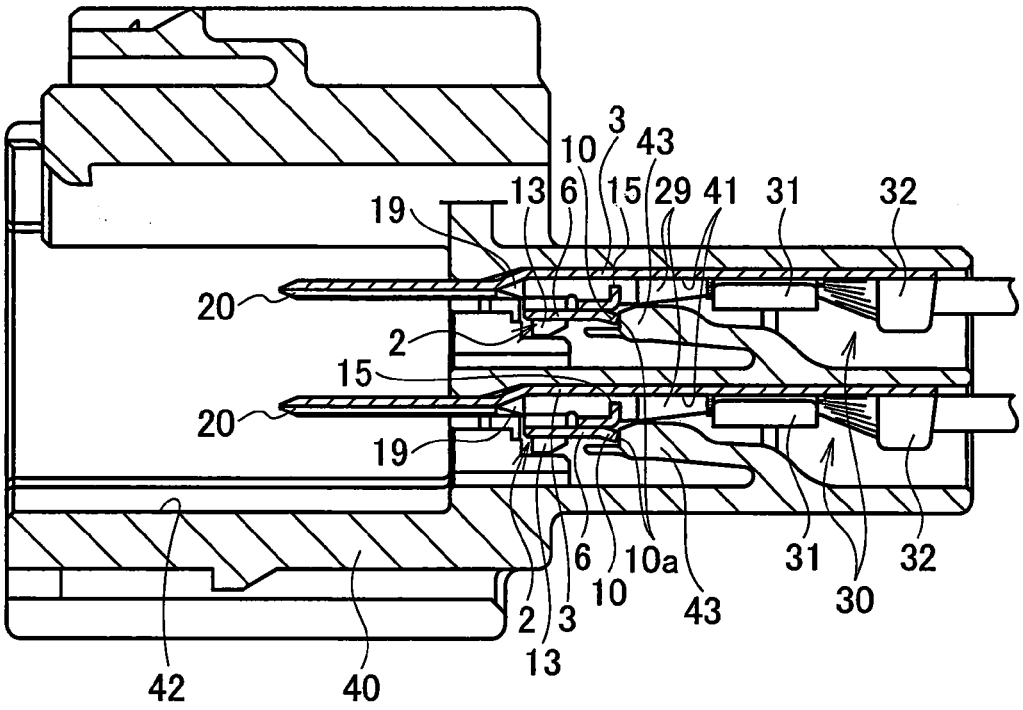
FIG. 6 is a sectional view taken along line B-B of FIG. 5.
Figure 7:
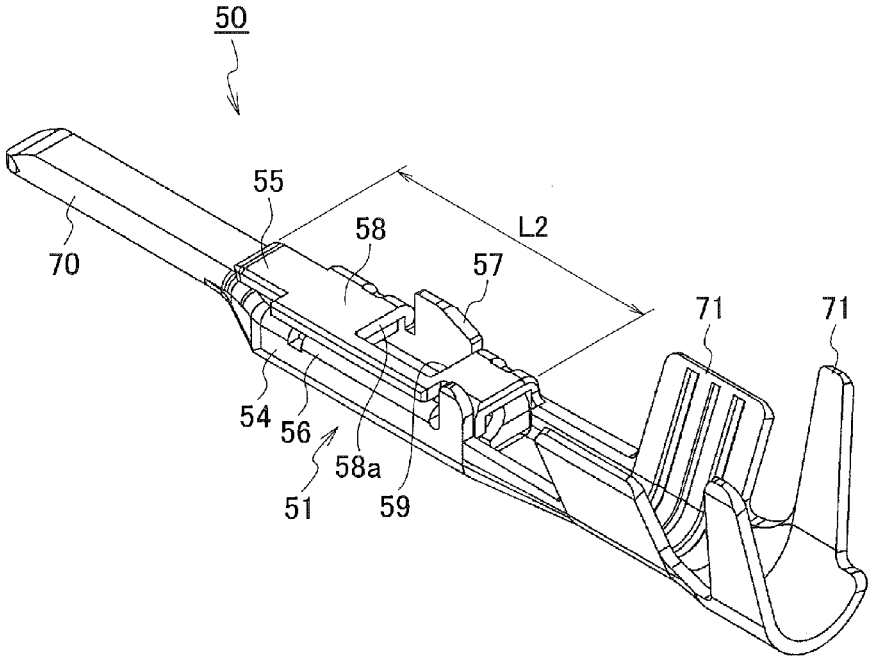
FIG. 7 PRIOR ART
FIG. 7 is a perspective view of a male terminal as a conventional terminal.
Figure 8:
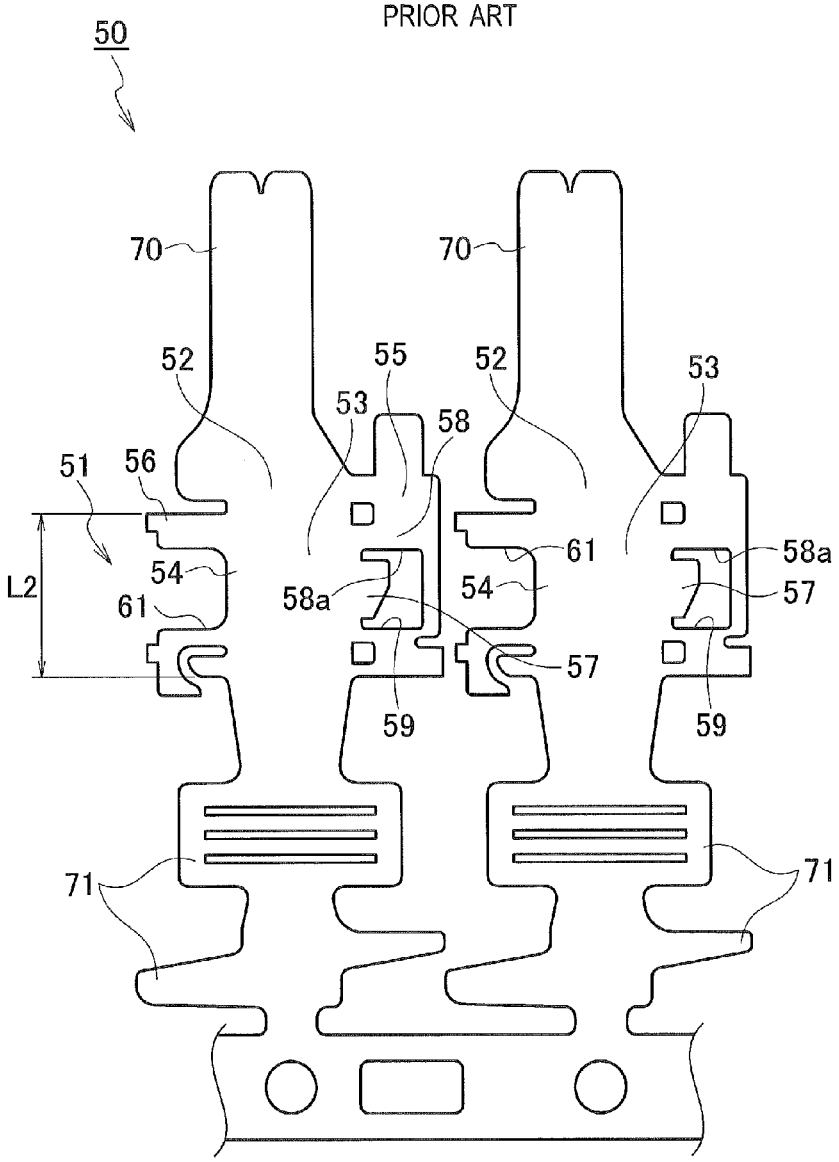
FIG. 8 PRIOR ART
FIG. 8 is a plan view of the male terminal as the conventional terminal before being folded.

The male terminal 1 is housed in a connector housing 40, as illustrated in FIGS. 5 and 6. In FIGS. 5 and 6, a plurality of terminal housing chambers 41 and a connector fitting chamber 42 in which a counterpart connector (not illustrated) is fitted are provided in the connector housing 40. The front end side of each of the terminal housing chambers 41 is opened to the connector fitting chamber 42, and the rear end side of each of the terminal housing chambers 41 is opened externally. At the connector housing 40, elastic lances 43 are provided so as to face each of the terminal housing chambers 41, respectively. At the connector housing 40, guide grooves (not illustrated) are disposed along each of the terminal housing chambers 41, respectively.

Next, a housing operation of the male terminal 1 will be explained. The male terminal 1 is inserted from an opening on a rear side of the terminal housing chamber 41. Then, a front end of the body part 2 of the male terminal 1 interferes with the elastic lance 43 but the elastic lance 43 is flexurally deformed to allow insertion of the male terminal 1. Once the male terminal 1 is inserted up to an insertion completion position, the terminal contact part 20 of the male terminal 1 is protruded in the connector fitting chamber 42 and the elastic lance 43 is returningly deformed so as to be engaged with the engagement section 10. Accordingly, the male terminal 1 is fixed to the terminal housing chamber 41 while being positioned.

When the male terminal 1 is inserted into the terminal housing chamber 41 of the connector housing 40, the stabilizer 13 serves as a guide by being inserted in a guide groove (not illustrated) inside the connector housing 40, and prevents an insertion in a direction other than a proper terminal direction (such as a direction that is turned upside down). The elastic lance 43 is engaged with the engagement section 10 in a state that the male terminal 1 is housed in the terminal housing chamber 41. Thus, movement of the male terminal 1 in a direction of coming off from the terminal housing chamber 41 is inhibited. When another male terminal 1 is inserted into the terminal housing chamber 41 in which the male terminal 1 is already housed, the tab-entry-prevention part 15 blocks the insertion of the other male terminal 1. Accordingly, a situation in which a plurality of male terminals 1 are housed in one terminal housing chamber 41 can be prevented.

As explained above, with the male terminal 1 as the terminal according to the embodiment, in the body part 2, the first slit 8 which opens on the side end face 6*a* is provided at the top wall 6, and the second slit 12 which opens on the side end face 7*a* is provided at the auxiliary wall 7. The stabilizer 13 is formed by a separated portion on the front side of the second slit 12 of the auxiliary wall 7, and the tab-entry-prevention part 15 is formed by a portion on the rear side of the second slit 12 of the auxiliary wall 7. The stabilizer reinforcing section 9 is formed by a separated portion on the front side of the first slit 8 of the top wall 6, and the engagement section 10 is formed by a portion on the rear side of the first slit 8 of the top wall 6. Accordingly, by simply forming the first slit 8 on the top wall 6 and the second slit 12 on the auxiliary wall 7, the stabilizer reinforcing section 9, the engagement section 10, the stabilizer 13, and the tab-entry-prevention part 15 are provided by utilizing the portions and the like separated by the first slit 8 and the second slit 12 without forming a hole such as in a conventional terminal. Thus, in the male terminal 1, it becomes possible to shorten the dimension L1 in the longitudinal direction of the body part 2, and thus, it is possible to downsize the box-shaped body part 2 in the male terminal 1. Moreover, since it is possible to make the electric resistance of the male terminal 1 small by downsizing the box-shaped body part 2, the electric performance of the male terminal 1 can be improved.

Also, even in a case in which the structure of the body part 2 such as of the embodiment is applied in a female terminal instead of the male terminal 1, it is possible to achieve an effect of downsizing the box-shaped body part of the female terminal.

The invention claimed is:

1. A terminal housed in a connector housing, comprising:
a box-shaped body part; and
an electric wire connecting part disposed on a rear side of the body part,
the body part comprising:
a bottom wall;
a first side wall raised from one side end of the bottom wall;
a second side wall raised from the other side end of the bottom wall;
a top wall which is extended from the first side wall; and
an auxiliary wall which is extended from the second side wall, wherein
a first slit which opens on a side end face of the top wall is provided at the top wall,
a second slit which opens on a side end face of the auxiliary wall is provided at the auxiliary wall,
a stabilizer is formed by a portion on a front side of the auxiliary wall, the portion on the front side of the auxiliary wall separated from a portion on a rear side of the auxiliary wall by the second slit of the auxiliary wall,
a stabilizer reinforcing section is formed by a portion on a front side of the top wall, the portion on the front side of the top wall separated from a portion on a rear side of the top wall by the first slit of the top wall, and
an engagement section engageable with an elastic lance of the connector housing is formed at the portion on the rear side of the top wall separated from the portion on the front side of the top wall by the first slit of the top wall.

2. The terminal according to claim 1, further comprising a terminal contact part which is disposed on a front side of the body part.

3. The terminal according to claim 2, wherein a tab-entry-prevention part is provided at the portion on the rear side of the auxiliary wall.

4. The terminal according to claim 1, wherein the electric wire connecting part comprises a conductor connecting part and an insulator connecting part, wherein
the conductor connecting part includes a first bottom wall and a pair of first tongue pieces protruded from both side ends of the first bottom wall,
the insulator connecting part includes a second bottom wall and a pair of second tongue pieces which are protruded from both side ends of the second bottom wall, and
the first bottom wall and the second bottom wall are bent into gradual arc-shapes toward the insides.

5. The terminal according to claim 1, wherein the top wall comprises a horizontal bending portion to be bent in a horizontal direction with respect to the first side wall and the top wall comprises a vertical bending portion to be bent in a vertical direction perpendicular to the top wall portion such that the stabilizer reinforcing section comes close to or comes in contact with the stabilizer to block inward deviation or inclination of the stabilizer.

6. The terminal according to claim 1, wherein the engagement section comprises a raised portion that is raised compared to other portions of the top wall by a triangular shaped fold.

7. The terminal according to claim 6, wherein a rear end face of the engagement section comprises an engagement face.

8. The terminal according to claim 1, wherein a rear space of the top wall comprises an entry space for an elastic lance.

9. The terminal according to claim 1, wherein
the stabilizer, formed by the portion on the front side of the auxiliary wall, is arranged straight with respect to the second side wall and protrudes in a vertical direction,
a tab-entry-prevention part is provided at a portion on the rear side of the auxiliary wall separated from the front side of the auxiliary wall by the second slit, and
the tab-entry-prevention part to be bent vertically downward with respect to the vertical direction in which the stabilizer protrudes, the tab-entry-prevention part closing a rear opening of the body part.

10. The terminal according to claim 1, wherein the connector housing comprises a plurality of terminal housing chambers and a connector fitting chamber into which a counterpart connector is to be fitted.

11. The terminal according to claim 10, wherein
the front end side of each of the terminal housing chambers is opened to the connector fitting chamber, and
the rear end side of each of the terminal housing chambers is opened externally.

12. The terminal according to claim 11, wherein the connector housing comprises
elastic lances that face each of the terminal housing chambers, respectively.

13. The terminal according to claim 11, wherein the stabilizer prevents an insertion of the terminal into the respective terminal housing chamber in a direction other than a proper terminal direction.

* * * * *